US006208252B1

(12) United States Patent
Danilychev

(10) Patent No.: US 6,208,252 B1
(45) Date of Patent: Mar. 27, 2001

(54) LOW INTENSITY FLAME DETECTION SYSTEM

(76) Inventor: Vladimir A. Danilychev, 4501 Pinyon Tree La., Irvine, CA (US) 92715

( * ) Notice: Subject to any disclaimer, the term of this patent is extended or adjusted under 35 U.S.C. 154(b) by 0 days.

(21) Appl. No.: 09/219,399

(22) Filed: Dec. 23, 1998

(51) Int. Cl.[7] ..... G08B 17/12
(52) U.S. Cl. ..... 340/577; 340/630
(58) Field of Search ..... 340/577, 578, 340/579, 584, 628, 629, 630, 521, 522; 250/574; 356/438

(56) References Cited

U.S. PATENT DOCUMENTS 4,266,219 * 5/1981 Foster et al. ..... 340/636
4,306,229 * 12/1981 Tamura et al. ..... 340/629
4,639,605 * 1/1987 Seki et al. ..... 340/578
4,763,115 * 8/1988 Cota ..... 340/521
4,792,797 12/1988 Tanguay ..... 340/628
4,857,895 * 8/1989 Kaprelian ..... 340/630
5,227,640 * 7/1993 Nomura et al. ..... 340/578
5,257,015 * 10/1993 Lewkowicz ..... 340/578
5,280,272 * 1/1994 Nagashima et al. ..... 340/630
5,581,241 * 12/1996 Kaufman et al. ..... 340/630

* cited by examiner

*Primary Examiner*—Jeffery A. Hofsass
*Assistant Examiner*—Daniel Previl

(57) ABSTRACT

A smoking detection device comprising a smoke sensor for generating an electrical signal in response to the detection of smoke, and an optical sensor for generating an electrical signal in response to the detection of ultraviolet radiation in a prescribed range. The smoking detection device may further comprise an alarm unit which is electrically connected to the smoke and optical sensors for generating an alarm signal in response to any one of the electrical signals generated by the smoke and optical sensors. The optical sensor is configured to sense ultraviolet radiation in a spectral range of from about 185 nanometers to about 260 nanometers, and of an intensity in a range of about 1 picowatt per square centimeter to about 1 nanowatt per square centimeter.

30 Claims, 2 Drawing Sheets

LOW INTENSITY FLAME DETECTION SYSTEM

FIELD OF THE INVENTION

The present invention relates generally to smoke detection equipment, and more particularly to a tobacco smoking detection device which has the combined capabilities of detecting or sensing smoke and the flame typically used to ignite the tobacco.

BACKGROUND OF THE INVENTION

Steadily increasing awareness to the risks of tobacco smoking and the medical complications associated with second-hand smoke have recently lead to the banning of smoking in many public places. In the past, tobacco smoking has typically been barred at institutions such as schools and hospitals. Recently however, certain states, including California, have passed legislation which outlaws tobacco smoking in all public buildings, including office buildings, bars, and restaurants. However, despite the many federal, state, and local government imposed smoking prohibitions or restrictions currently in place, there are many individuals who chose to ignore such restrictions and engage in tobacco smoking in public places.

There is currently known in the prior art various tobacco smoke detection systems or devices which are operative to sense or detect moderate to heavy levels of tobacco smoke. These prior art devices typically detect such smoke through the use of dual ionization, photoelectric, or combined ionization-photoelectric smoke detection units. Since these prior art devices are operative only to detect moderate to heavy levels of tobacco smoke, they are largely ineffective in outdoor areas or in large, well ventilated rooms where the tobacco smoking activity may occur in a location which is at some distance from the smoke detector, thus not providing a sufficient level of smoke to cause the same to generate or activate a suitable alarm.

Also known in the prior art are tobacco smoking detection devices which, in addition to being operable to sense tobacco smoke, are further operable to detect or sense the infrared heat signature generated by burning cigarettes or cigars. These types of prior art tobacco smoking detection devices, like those operable to sense tobacco smoke only, are typically effective for use in small rooms such as the lavatories of airplanes or in small offices, but also lack the sensitivity needed to detect tobacco smoking in well ventilated large rooms or outdoor areas outside of a building. Additionally, though being operable to detect the infrared heat signature of a burning cigarette or cigar, such prior art devices have low sensitivity to detecting the infrared heat signature generated by burning tobacco pipes, and may generate false signals from heat sources other than a burning cigarette or cigar.

The present invention overcomes the deficiencies associated with prior art tobacco smoking detection devices, and is based on the fundamental principle that tobacco smoking is typically initiated with the actuation of a cigarette lighter or the burning of a match which is used to fire or ignite a cigarette, cigar, or tobacco pipe. In this respect, the present invention provides a tobacco smoking detection device which is operable to sense or detect the flame used to facilitate the lighting or firing of the tobacco. In addition to being adapted to accomplish such flame detection at substantial distances, the detection device of the present invention is also specifically configured to ignore the effects of background optical radiation, and thus not generate false alarms as a result thereof. More particularly, though being operable to detect a flame of a cigarette lighter at distances of up to about 300 feet, the present detection device is not triggered as a result of sunlight, objects heated to high temperatures from sunlight, heated car engines, building heaters, or incandescent or fluorescent lamps. The present detection device is also provided with smoke detecting capability for those instances when an individual enters into the monitored area with a previously lit cigarette, cigar or pipe, or for those instances when smoking is started via a cigarette-to-cigarette tobacco lighting process. These, and other advantages associated with the present detection device, will be discussed in more detail below.

SUMMARY OF THE INVENTION

In accordance with the present invention, there is provided a smoking detection device comprising a smoke sensor or detector for generating an electrical signal in response to the detection of smoke. In addition to the smoke sensor, the detection device comprises an optical sensor or detector for generating an electrical signal in response to the detection of ultraviolet radiation in a prescribed range. Typically, such ultraviolet radiation is produced by the flame of a cigarette lighter or a burning match. The present detection device may further comprise an alarm unit which is electrically connected to the smoke and optical sensors for generating an alarm signal in response to any one of the electrical signals generated by the smoke and optical sensors. The alarm unit may comprise a buzzer for purposes of generating an audible alarm, and/or an LED or other signaling device for generating a visible alarm. The alarm unit may also comprise an electronic unit which provides an audio voice warning signal to the offending smoker. The present detection device may also further comprise a power supply (e.g., a battery) which is electrically connected to the smoke and optical sensors and to the alarm unit. Additionally, it is contemplated that the present detection device may include, as an alternative to the alarm unit, a transmission unit for transmitting any one of the electrical signals generated by the smoke and optical sensors to a remote receiver unit which itself may generate an audible and/or visible alarm.

The smoke sensor of the present detection device is preferably a dual ionization smoke detection unit. The optical sensor is preferably configured to sense ultraviolet radiation in a spectral range or region (i.e., an optical band) of from about 185 nanometers to about 260 nanometers. Advantageously, since sun radiation in this particular optical domain is trapped by the atmospheric ozone layer, the noise level of false signals from sunlight is extremely low. Indeed, direct sunlight or sun radiation has no influence on the operation of the present detection device to altitudes of up to about 10,000 feet. Additionally, the sensing of ultraviolet radiation in this particular range substantially reduces the susceptibility of the optical sensor to false signals from low thermal background optical radiation generated by, for example, objects heated to high temperatures from sunlight, heated car engines, building heaters, and incandescent or fluorescent lamps. Additionally, the optical sensor is configured so as to allow the gain and sensitivity thereof to be raised to a level to reliably sense very weak optical signals, i.e., incident ultraviolet radiation of an intensity in a range of about 1 picowatt per square centimeter to about 1 nanowatt per square centimeter.

The optical sensor is also preferably configured to sense ultraviolet radiation at a wide spacial detection angle of up to about 360 degrees. However, the optical sensor may be provided with an optical concentrator for narrowing the spacial detection angle to no greater than about 60 degrees. The optical concentrator may comprise either a parabolic reflective light concentrator or a refractive ultraviolet transparent lens. In those embodiments wherein the optical sensor is not provided with an optical concentrator, it possesses the capability to detect the flame produced by a cigarette lighter or a burning match at a distance of up to about 60 feet. This distance may be increased to up to about 300 feet by providing the optical sensor with a suitable optical concentrator. The optical sensor is preferably selected from the group consisting of vacuum solar blind photomultiplier tubes, semiconductor sensors with ultraviolet filters, solar blind avalanche vacuum photodiodes, gas-filled photodiodes, and semiconductor photodiodes.

Further in accordance with the present invention, there is provided a smoking detection system which includes at least two of the above-described smoking detection devices. In a preferred smoking detection system, the smoking detection devices are in electrical communication with a remote receiver unit which is adapted to receive any one of the electrical signals generated by the smoke and optical sensors, and to generate either a visual and/or audible alarm in response to the presence of optical radiation within the prescribed range and/or tobacco smoke. The detection devices may either be electrically connected (i.e., hard wired) to the receiver unit, or in radio or infrared frequency communication therewith. In this respect, direct electrical connections via wire may be established between the smoke and optical sensors of the detection devices and the receiver unit, with radio or infrared frequency communication being achievable via the inclusion of the aforementioned transmission unit within each of the detection devices. Each of the detection devices may include optical concentrators for increasing their operational range, with as many detection devices being included in the system as are needed to monitor the entirety of a desired space or area.

Further in accordance with the present invention, there is provided a method of detecting tobacco smoking in a defined area through the use of at least one of the above-described smoking detection devices. The method includes the step of positioning the smoking detection device such that the optical sensor thereof is capable of sensing the prescribed range of ultraviolet radiation within the defined area. Thereafter, an alarm signal is generated in response to any one of the electrical signals generated by the smoke and optical sensors. In the preferred method, the electrical signals are transmitted to a local alarm unit or a remote receiver unit, with an audible and/or visible alarm being generated by the receiver unit itself. The optical sensor of the detection device may be configured to sense ultraviolet radiation at a spacial detection angle of up to about 360 degrees, with the detection device being positioned such that such spacial detection angle encompasses the defined area. Alternatively, multiple detection devices may be employed in the method, with each of the optical sensors thereof being configured to sense the prescribed range of ultraviolet radiation at a particular spacial detection angle, and the detection devices being positioned such that such spacial detection angles collectively encompass or cover the defined smoke restricted area.

BRIEF DESCRIPTION OF THE DRAWINGS

These, as well as other features of the present invention, will become more apparent upon reference to the drawings wherein.

DETAILED DESCRIPTION OF THE PREFERRED EMBODIMENTS

Figure 1:
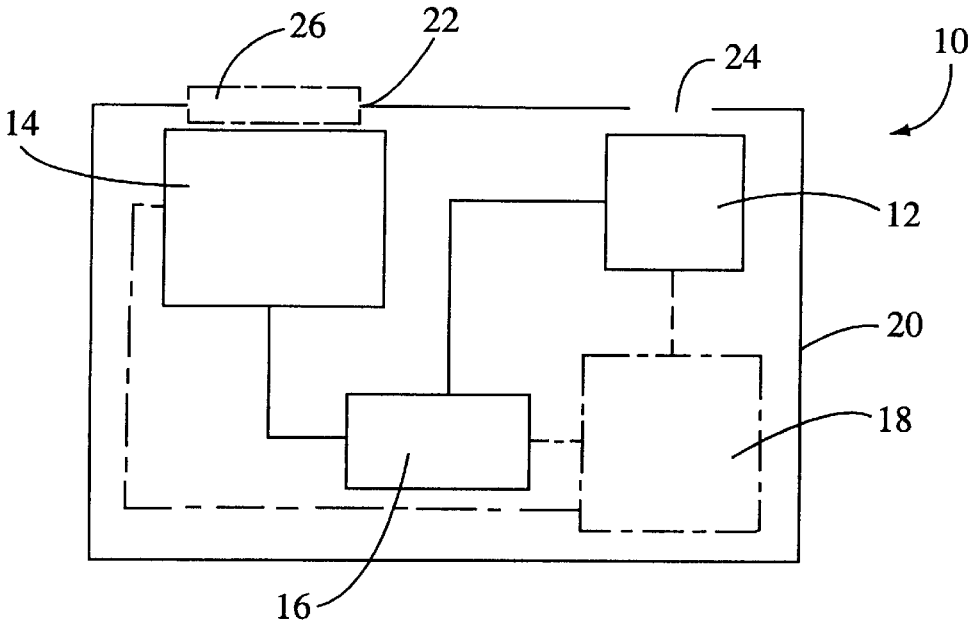
FIG. 1 is a block diagram of a smoking detection device constructed in accordance with a first embodiment of the present invention.

Referring now to the drawings wherein the showings are for purposes of illustrating preferred embodiments of the present invention only, and not for purposes of limiting the same, FIG. 1 depicts a smoking detection device 10 constructed in accordance with a first embodiment of the present invention. The detection device 10 comprises a smoke sensor 12 for generating an electrical signal in response to the detection of smoke. In addition to the smoke sensor 12, the detection device 10 includes an optical sensor 14 for generating an electrical signal in response to the detection of ultraviolet radiation in a prescribed range. As previously indicated, such ultraviolet radiation is produced by the flame of a cigarette lighter or a burning match.

The smoke sensor 12 is preferably a dual ionization smoke detection unit, though the same may alternatively comprise a photoelectric unit or a combined ionization-photoelectric unit. The optical sensor 14 is itself preferably configured to sense ultraviolet radiation in a spectral range or region (i.e., an optical band) of from about 185 nanometer to about 260 nanometers. As also indicated above, since sun radiation in this particular optical domain is trapped by the atmospheric ozone layer, the noise level of false signals from sunlight is extremely low when using the detection device 10. Indeed, direct sunlight or sun radiation has no influence on the operation of the detection device 10 to altitudes of up to about 10,000 feet. Additionally, the sensing of ultraviolet radiation in this prescribed range substantially reduces the susceptibility of the optical sensor 14 to false signals from low thermal background optical radiation generated by, for example, objects heated to high temperatures from sunlight, heated car engines, building heaters, and incandescent or fluorescent lamps. Further, the optical sensor 14 is configured so as to allow the gain and sensitivity thereof to be raised to a level to reliably sense very weak optical signals, i.e., incident ultraviolet radiation of an intensity in a range of about 1 picowatt per square centimeter to about 1 nanowatt per square centimeter.

In addition to the smoke and optical sensors 12, 14, the detection device 10 of the first embodiment further comprises an alarm unit 16 which is electrically connected to the smoke and optical sensors 12, 14 for generating an alarm signal in response to any one of the electrical signals generated by the smoke and optical sensors 12, 14. The alarm unit 16 may include a buzzer or other noise making unit for purposes of generating an audible alarm, and/or an LED or other signaling device for generating a visible alarm. The alarm unit 16 may also include an electronically generated voice warning signal unit. In addition to the above-described components, the detection device 10 may also include a power supply 18 (shown in phantom in FIG. 1) which is electrically connected to the smoke and optical sensors 12, 14 and the alarm unit 16. The power supply 18 will typically comprise one or more conventional batteries which require periodic replacement within the detection device 10. Those of ordinary skill in the art will recognize that if the on-board power supply 18 is not included in the detection device 10, an alternative source of power, such as a conventional plug-in connection, will be needed to supply power to the smoke and optical detectors 12, 14 and to the alarm unit 16.

In the detection device 10 of the first embodiment, the smoke and optical sensors 12, 14, alarm unit 16, and power supply 18 (if included) are disposed within a housing 20. The housing 20 is preferably provided with a first opening 22 which allows for the exposure of the optical sensor 14 to ultraviolet radiation, and a second opening 24 which allows for the exposure of the smoke sensor 12 to tobacco smoke. Though not shown, any buzzer or other noise making unit of the alarm unit 16 would preferably be included on an external surface of the housing 20. Similarly, an LED or other visual indication device of the alarm unit 16 would preferably be provided on an easily viewable external surface of the housing 20.

The optical sensor 14 of the detection device 10 is normally operable to sense ultraviolet radiation at a wide spacial detection angle of up to about 360 degrees. The spacial detection angle of the optical sensor 14 is its view angle or the range at which it is able to sense ultraviolet radiation. However, when the optical sensor 14 is disposed within the housing 20 adjacent the first opening 22 in the manner shown in FIG. 1, the spacial detection angle thereof is limited to about 180 degrees. Such spacial detection angle could be increased to about 360 degrees by configuring the smoking detection device 10 such that the optical sensor 14 protrudes from within the housing 20 via the first opening 22.

Figure 3:
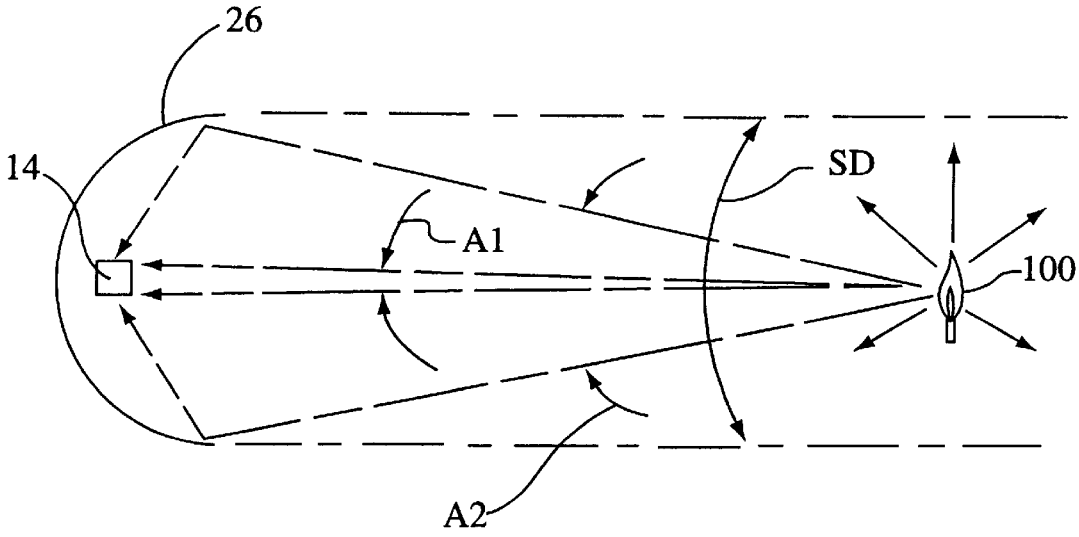
FIG. 3 is a schematic depiction illustrating the manner in which the inclusion of an optical concentrator in the present smoking detection device modifies the performance characteristics thereof.

Referring now to FIGS. 1 and 3, it is contemplated that the optical sensor 14 may be provided with an optical concentrator 26 (also shown in phantom in FIG. 1) which itself may be positioned within the first opening 22 of the housing 20. As seen in FIG. 3, without the optical concentrator 26, the optical sensor 14 is able to collect the light or ultraviolet radiation generated from a light source 100 such as a flame at only a relatively narrow sensing angle A1. The inclusion of the optical concentrator 26 with the optical sensor 14 allows is to collect light or ultraviolet radiation from a substantially larger sensing angle A2, thus resulting in a higher signal and an increase in the detection distance of the optical sensor 14. However, the optical concentrator 26 limits or narrows the spacial detection angle of the optical sensor 14 to the spacial detection angle labeled SD in FIG. 3, similar to the manner in which a pair of binoculars or a telescope limit a spacial detection angle. More particularly, in the smoking detection device 10, the inclusion of the optical concentrator 26 with the optical sensor 14 narrows the spacial detection angle thereof to about 60 degrees or less.

The optical concentrator 26 may comprise either a parabolic reflective light concentrator(s) (as shown in FIG. 3) or a refractive ultraviolet transparent lens(es). When the optical sensor 14 is not provided with the optical concentrator 26, it possesses the capability to detect the flame produced by a cigarette lighter or a burning match to a distance of up to about 60 feet. This distance may be increased to up to about 300 feet by providing the optical sensor 14 with the optical concentrator 26. In the detection device 10, the optical sensor 14 is preferably selected from the group consisting of vacuum solar blind photomultiplier tubes, semiconductor sensors with ultraviolet filters, solar blind avalanche vacuum photodiodes, gas-filled photo diodes, and semi conductor photodiodes.

Figure 2:
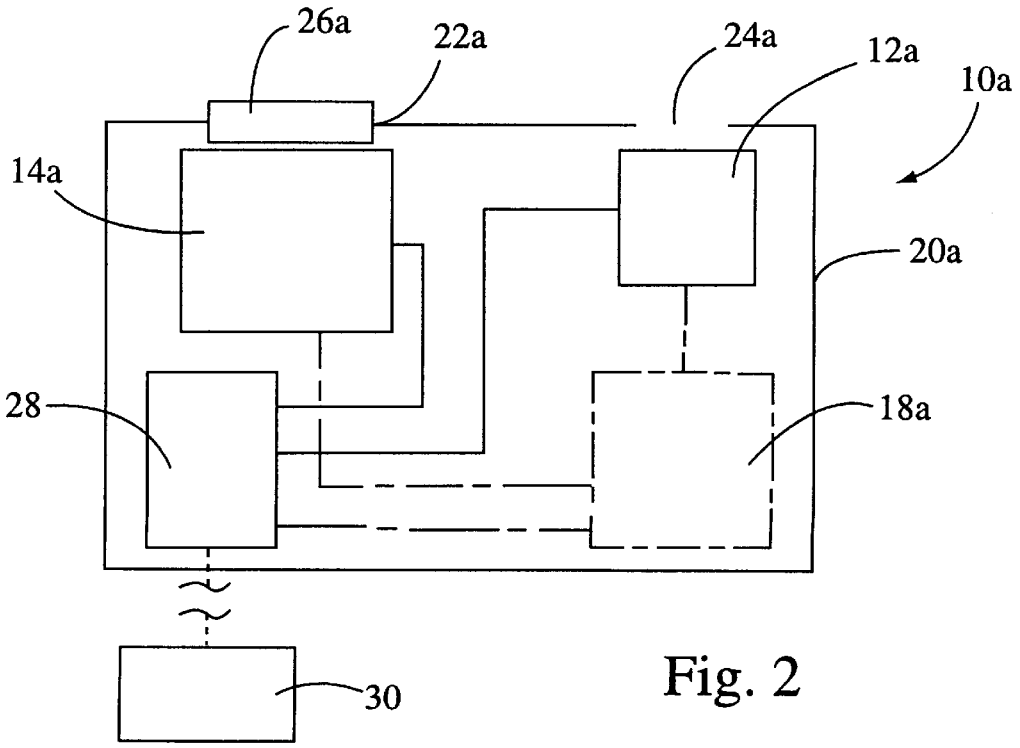
FIG. 2 is a block diagram of a smoking detection device constructed in accordance with a second embodiment of the present invention.

Referring now to FIG. 2, there is depicted a smoking detection device 10*a* constructed in accordance with a second embodiment of the present invention. The detection device loa includes a smoke sensor 12*a* and an optical sensor 14*a* which are identical to the previously described smoke and optical sensors 12, 14. Additionally, preferably included with the optical sensor 14*a* in the detection device 10*a* is an optical concentrator 26*a* which is identical to the previously described optical concentrator 26. However, in the detection device 10*a*, the smoke and optical sensors 12*a*, 14*a* are electrically connected to a transmission unit 28 rather than to the alarm unit 16 as described in relation to the detection device 10.

The transmission unit 28 of the detection device 10*a* is adapted to established radio frequency communication between the detection device 10*a* and a remote receiver unit 30. Rather than establishing radio frequency communication, the transmission unit 28 may also establish infrared communication between the detection device 10*a* and the remote receiver unit 30. In this respect, the receiver unit 30 is adapted to receive any one of the electrical signals generated by the smoke and optical sensors 12*a*, 14*a* of the detection device 10*a*, and to generate either a visual and/or audible alarm in response to the presence of optical radiation within the prescribed range and/or tobacco smoke. Rather than being in radio frequency or infrared communication with the receiver unit 30, the smoke and optical sensors 12*a*, 14*a* of the detection device 10*a* may be hard wired directly to the receiver unit 30 to facilitate the direct transmission of the electrical signals indicative of the presence of a flame and/or tobacco smoke thereto. As will be recognized, the direct electrical connection of the smoke and optical sensors 12*a*, 14*a* to the receiver unit 30 would eliminate the need for the transmission unit 28 which, as indicated above, is used to facilitate radio frequency or infrared communication between the detection device 10*a* and the receiver unit 30.

As in the detection device 10 of the first embodiment, the detection device 10*a* of the second embodiment may also include an on-board power supply 18*a* (shown in phantom in FIG. 2) which is electrically connected to the smoke and optical sensors 12*a*, 14*a* and transmission unit 28 (if included). The smoke and optical sensors 12*a*, 14*a*, transmission unit 28 (if included) and power supply 18*a* (if included) of the detection device 10*a* are preferably disposed within a housing 20*a* thereof which is identical to the previously described housing 20. In this respect, the optical sensor 14*a* is located adjacent a first opening 22*a* disposed within the housing 20*a*, with the smoke sensor 12*a* being disposed adjacent a second opening 24*a* within the housing 20*a* and the optical concentrator 26*a* preferably being positioned within the first opening 22*a*.

It is contemplated that multiple detection devices 10*a* constructed in accordance with the second embodiment of the present invention may be incorporated into a smoking detection system which is adapted to monitor a defined space or area. In such a system, two or more detection devices 10*a* would be placed into electrical communication with a common receiver unit 30. As indicated above, such electrical communication could be accomplished by hard wiring the smoke and optical sensors 12*a*, 14*a* of the detection devices 10*a* to the receiver unit 30, or by radio or infrared frequency communication via the inclusion of a transmission unit 28 within each of the detection devices 10*a*. The detection devices 10*a* would be positioned such that the spacial detection angles of the optical sensors 14*a* thereof would collectively encompass or cover the entirety of the defined space or area. Though the inclusion of the optical concentrators 26*a* with the optical sensors 14*a* increases the operational distances thereof, as previously explained, such optical concentrators 26*a* narrow the spacial detection angles of the optical sensors 14*a* to about 60 degrees or less. Thus, to effectively encompass a defined area of a large size, it would be necessary to include multiple detection devices 10*a* within the smoking detection system.

In the above-described smoking detection system, the receiver unit 30 could be configured such that an identifiable correlation is established between the specific locations of the various detection devices loa of the system and the regions within the defined area which are being monitored thereby. In this respect, the receiver unit 30 could be used to determine, with some accuracy, the location within the defined area where the flame originated, therefore making it easier to locate and confront the offending smoker.

The optical sensor 14 of the detection device 10 of the first embodiment will typically not be provided with the optical concentrator 26 so as to maximize the spacial detection angle thereof. In those instances where the defined area to be monitored for tobacco smoking is of a relatively small size and a determination of the location of origin of the flame is not particularly important, such monitoring may be achieved through the use of one properly positioned detection device 10. Defined areas of a larger size may also be monitored through the use of multiple, properly positioned detector devices 10 with or without optical concentrators 26. A single detection device 10*a* constructed in accordance with the second embodiment (with or without the optical concentrator 26*a*) may also be employed for monitoring defined areas of relatively small size. Additionally, a single detection device 10*a* or multiple detection devices 10*a* which do not include optical concentrators 26*a* may be used to monitor defined areas of a relatively large size in those instances where the location of origin of the flame is not important.

Additional modifications and improvements of the present invention may also be apparent to those of ordinary skill in the art. Thus, the particular combination of parts and steps described and illustrated herein is intended to represent only certain embodiments of the present invention, and is not intended to serve as limitations of alternative devices within the spirit and scope of the invention.

What is claimed is:

1. A detection device for detecting a low intensity flame used to initiate a smoking activity, the detection device comprising:

an optical sensor configured to sense ultraviolet radiation in a spectral range of from about 185 nanometers to about 260 nanometers and in an intensity range of from about 1 picowatt per square centimeter to about 1 nanowatt per square centimeter, the optical sensor being operative to generate an electrical signal in response to the detection of ultraviolet radiation in the spectral and intensity ranges.

2. The detection device of claim 1 further comprising an alarm unit electrically connected to the optical sensor and operative to generate an alarm signal in response to the electrical signal generated by the optical sensor.

3. The detection device of claim 2 further comprising a smoke sensor operative to generate an electrical signal in response to the detection of smoke, the alarm unit being electrically connected to the smoke sensor and operative to generate the alarm signal is response to any one of the electrical signals generated by the smoke and optical sensors.

4. The detection device of claim 3 wherein the alarm signal is audible.

5. The detection device of claim 3 wherein the alarm signal is visible.

6. The detection device of claim 3 further comprising a power supply electrically connected to the smoke and optical sensors and the alarm unit.

7. The detection device of claim 3 wherein the smoke sensor is selected from the group consisting of:

a dual ionization smoke detection unit;

a photoelectric smoke detection unit; and a combined ionization-photoelectric smoke detection unit.

8. The detection device of claim 1 further comprising a transmission unit electrically connected to the optical sensor and operative to transmit the electrical signal generated by the optical sensor to a remote receiver unit.

9. The detection device of claim 8 further comprising a smoke sensor operative to generate an electrical signal in response to the detection of smoke, the transmission unit being electrically connected to the smoke sensor and operative to transmit any one of the electrical signals generated by the smoke and optical sensors to the remote receiver unit.

10. The detection device of claim 1 wherein the optical sensor is configured to sense ultraviolet radiation at a spacial detection angle of up to about 360 degrees.

11. The detection device of claim 10 wherein the optical sensor further comprises an optical concentrator for narrowing the spacial detection angle to no greater than about 60 degrees.

12. The detection device of claim 11 wherein the optical concentrator comprises at least one parabolic reflective light concentrator.

13. The detection device of claim 11 wherein the optical concentrator comprises at least one refractive ultraviolet transparent lens.

14. The detection device of claim 1 wherein the optical sensor is selected from the group consisting of:

vacuum solar blind photomultiplier tubes;

semiconductor sensors with ultraviolet filters;

solar blind avalanche vacuum photodiodes;

gas filled photodiodes; and semiconductor photodiodes.

15. A detection system for detecting a low intensity flame used to initiate a smoking activity, the detection system comprising:

at least two detection devices, each of the detection devices comprising:

an optical sensor configured to sense ultraviolet radiation in a spectral range of from about 185 nanometers to about 260 nanometers and in an intensity range of from about 1 picowatt per square centimeter to about 1 nanowatt per square centimeter, the optical sensor being operative to generate an electrical signal in response to the detection of ultraviolet radiation in the spectral and intensity ranges;

the optical sensor including an optical concentrator for causing the optical sensor to sense ultraviolet radiation at a prescribed spacial detection angle; and a receiver unit in electrical communication with the detection devices and operable to generate an alarm signal in response to the electrical signal generated by the optical sensor.

16. The detection system of claim 15 wherein each of the detection devices further comprises a smoke sensor operative to generate an electrical signal in response to the detection of smoke, the receiver unit being operative to generate the alarm signal in response to any one of the electrical signals generated by the smoke and optical sensors.

17. The detection system of claim 16 wherein the alarm signal is audible.

18. The detection system of claim 16 wherein the alarm signal is visible.

19. The detection system of claim 16 wherein the receiver unit is electrically connected to the smoke and optical sensors of the smoking detection devices.

20. The detection system of claim 16 wherein each of the detection devices further includes a transmission unit which is electrically connected to the smoke and optical sensors, and the receiver unit is in radio frequency communication with the transmission units of the detection devices.

21. The detection system of claim 15 wherein the spacial detection angle of the optical sensor of each of the detection devices does not exceed about 60 degrees.

22. The detection system of claim 15 wherein each of the detection devices further includes a transmission unit which is electrically connected to the optical sensor, and the receiver unit is in radio frequency communication with the transmission units of the detection devices.

23. A method for detecting a low intensity flame used to initiate a smoking activity in a defined area, the method comprising the steps of:

(a) providing at least one detection device having an optical sensor which is configured to sense ultraviolet radiation in a spectral range of from about 185 nanometers to about 260 nanometers and in an intensity range of from about 1 picowatt per square centimeter to about one nanowatt per square centimeter, and is operative to generate an electrical signal in response to the detection of ultraviolet radiation in the spectral and intensity ranges;

(b) positioning the detection device such that the optical sensor is capable of sensing ultraviolet radiation in the spectral and intensity ranges within the defined area; and (c) generating an alarm signal in response to the electrical signal generated by the optical sensor.

24. The method of claim 23 wherein:

step (a) comprises configuring the optical sensor of the detection device to sense ultraviolet radiation in the spectral and intensity ranges at a spacial detection angle of up to about 360 degrees; and step (b) comprises positioning the detection device such that the spacial detection angle thereof encompasses the defined area.

25. The method of claim 23 wherein:

step (a) comprises providing multiple detection devices and configuring each of the optical sensors thereof to sense ultraviolet radiation in the spectral and intensity ranges at a spacial detection angle not exceeding about 60 degrees; and step (b) comprises positioning the detection devices such that the spacial detection angles thereof collectively encompass the defined area.

26. The method of claim 23 wherein step (c) comprises:

(1) transmitting the electrical signal generated by the optical sensor to a remote receiver unit; and (2) generating the alarm signal from the remote receiver unit.

27. The method of claim 23 wherein:

step (a) comprises providing the detection device with a smoke sensor operative to generate an electrical signal in response to the detection of smoke; and step (c) comprises generating the alarm signal in response to any one of the electrical signals generated by the smoke and optical sensors.

28. The method of claim 27 wherein step (2) comprises generating an audible alarm signal.

29. The method of claim 27 wherein step (2) comprises generating a visible alarm signal.

30. The method of claim 27 wherein step (c) comprises:

(1) transmitting any one of the electrical signals generated by the smoke and optical sensors to a remote receiver unit; and (2) generating the alarm signal from the remote receiver unit.

* * * * *